US006289556B1

(12) United States Patent
Salice

(10) Patent No.: US 6,289,556 B1
(45) Date of Patent: Sep. 18, 2001

(54) FURNITURE HINGE

(75) Inventor: Luciano Salice, Carimate (IT)

(73) Assignee: Arturo Salice S.p.A., Novedrate (IT)

( * ) Notice: Subject to any disclaimer, the term of this patent is extended or adjusted under 35 U.S.C. 154(b) by 0 days.

(21) Appl. No.: 09/405,851

(22) Filed: Sep. 24, 1999

(30) Foreign Application Priority Data

Sep. 24, 1998 (DE) ..... 298 17 178 U

(51) Int. Cl.[7] ..... E05D 11/10

(52) U.S. Cl. ..... 16/335; 16/242; 16/281; 16/296

(58) Field of Search ..... 16/335, 284, 236–238, 16/242, 281, 296

(56) References Cited

U.S. PATENT DOCUMENTS

| | | | | |
|---|---|---|---|---|
| 3,835,585 | * | 9/1974 | Anderson et al. | 16/335 |
| 3,972,090 | | 8/1976 | Holmes . | |
| 4,502,182 | * | 3/1985 | Lautenschlager et al. | 16/288 |
| 4,716,622 | * | 1/1988 | DeBruyn | 16/297 |
| 5,027,474 | * | 7/1991 | Bowers | 16/335 |
| 5,355,557 | * | 10/1994 | Cress et al. | 16/335 |
| 5,500,983 | * | 3/1996 | Lautenschlager | 16/292 |
| 5,604,956 | * | 2/1997 | Grass | 16/335 |
| 5,737,804 | * | 4/1998 | Ferrari et al. | 16/335 |
| 6,125,508 | * | 10/2000 | Formenti | 16/335 |

FOREIGN PATENT DOCUMENTS

| | | |
|---|---|---|
| 325991 | 1/1975 | (AT) . |
| 2524454 | 12/1976 | (DE) . |
| 3218375 | 11/1983 | (DE) . |
| 9314375 U | 2/1994 | (DE) . |
| 296 11 392 U | 8/1996 | (DE) . |
| 0623725 | 11/1994 | (EP) . |

* cited by examiner

*Primary Examiner*—Chuck Y. Mah
(74) *Attorney, Agent, or Firm*—Dilworth & Barrese LLP

(57) ABSTRACT

A hinge, preferably a furniture hinge, is provided which comprises a hinge arm (1) pivoted on a hinge axle (3) held with a cup-shaped hinge part (4) and provided with a tongue extending over the hinge axle (3) or a cam eccentric to the hinge axle (3) or a metering notch which slide on a part pivoted or movably guided in the hinge part (4) and charged by at least one spring (28) and provided with a slide surface in a way such that a closing moment to the hinge part (4) in the closing region, is provided.

19 Claims, 2 Drawing Sheets

FURNITURE HINGE

BACKGROUND OF THE INVENTION

The invention relates to a hinge, preferably a furniture hinge, comprising a hinge arm pivoted on a hinge axle supported in a cup-shaped hinge part.

In such hinges, it is frequently desirable that they possess a closing characteristic on the basis of which a closing moment acts on the hinge in the closing region which closing moment keeps, for example, a door connected to the cup-shaped hinge part in the closed state so that any unwanted involuntary opening of the door is prevented.

SUMMARY OF THE INVENTION

It is therefore the object of the invention to propose a hinge of the type first given on whose cup-shaped hinge part a closing moment acts in the closing region with simple means so that the hinge can be manufactured in an economical manner.

This object is solved in accordance with the invention by a hinge with the hinge arm pivoted on a hinge axle held with a cup-shaped hinged part and provided with a tongue extending over the hinge axle or a cam eccentric to the hinge axle or a metering notch which slide on a part pivoted or movably guided in the hinge part and charged by at least one spring and provided with a slide surface in a way such that a closing moment to the hinge part in the closing region is provided.

The one-joint hinge in accordance with the invention can be manufactured and fitted with the spring-loaded part effecting the closing moment with relatively simple means.

Appropriately, the part comprises a two-arm lever pivoted in rocker-like fashion between whose one lever arm and an abutment of the hinge part a pressure spring is clamped with the tongue or cam sliding on its other lever arm. The rocker-like lever can be supported in a simple manner in a hinge cup with a pressure spring being able to be clamped between the first lever arm and a fixed part of the hinge part.

In accordance with a preferred embodiment, it is provided that the two-armed lever is essentially formed in a flat manner and is provided with a central groove running laterally with which it is pivoted on a bar or a reinforcing fin of the bottom of the cup-shaped hinge part.

The bar can be formed in a simple manner by a bent-down part of the bottom or a reinforcing fin embossed in the bottom of the cup-shaped hinge part if the cup-shaped hinge part comprises a stamped metal part.

Appropriately, the one lever arm of the two-armed lever is provided with lateral protrusions between which and the upper edge of the cup-shaped hinge part pressure springs are clamped.

One embodiment of the invention is described below in more detail by means of the drawing in which

DESCRIPTION OF THE PREFERRED EMBODIMENTS

Figure 1:
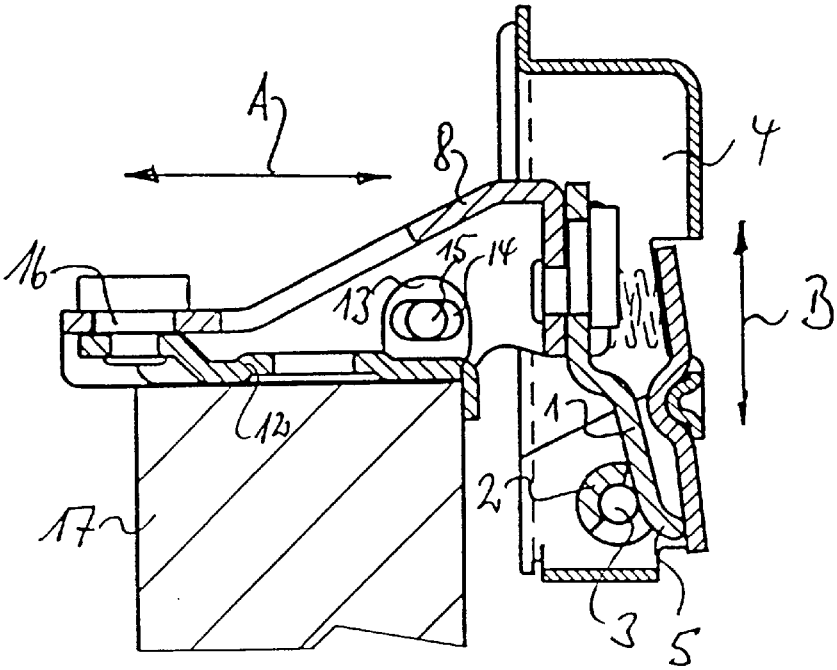
FIG. 1 shows a longitudinal section through a hinge with a retaining plate and a base plate in the closed state, which hinge is mounted on a door frame, for example of a piece of kitchen furniture.
Figure 2:
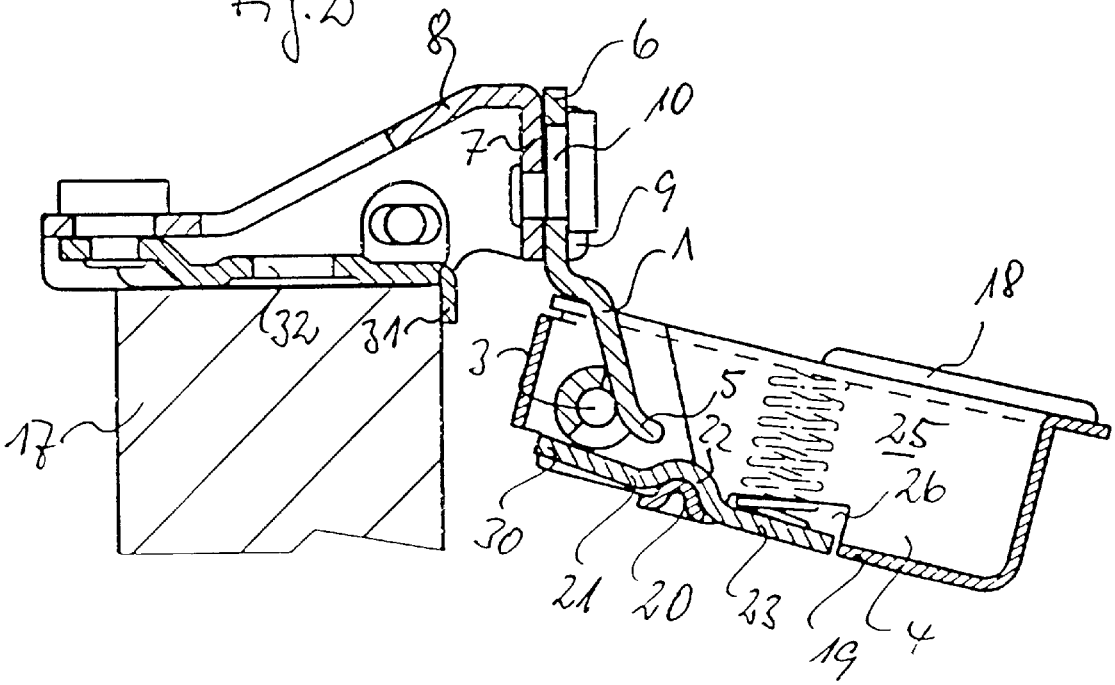
FIG. 2 shows the hinge of FIG. 1 in the opened state.
Figure 3:
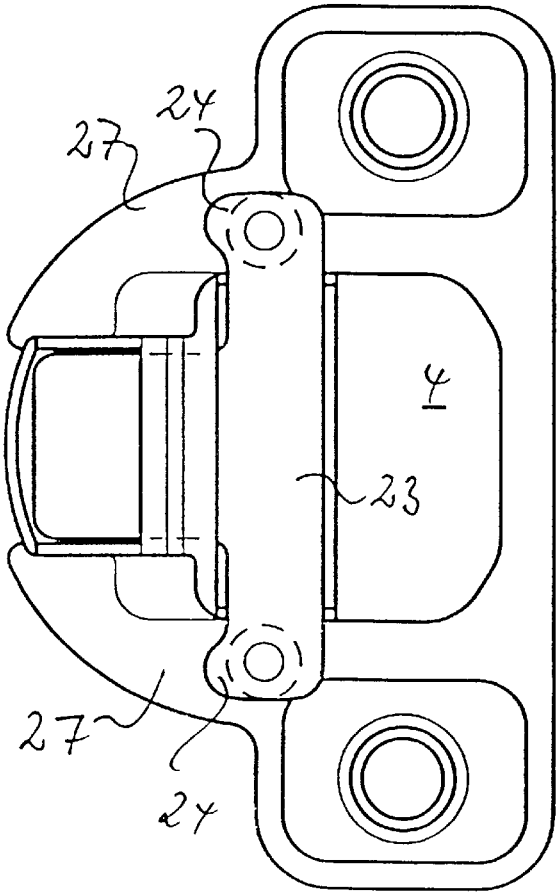
FIG. 3 shows a bottom view of the swivellable cup-shaped hinge part of the hinge of FIG. 1.
Figure 4:
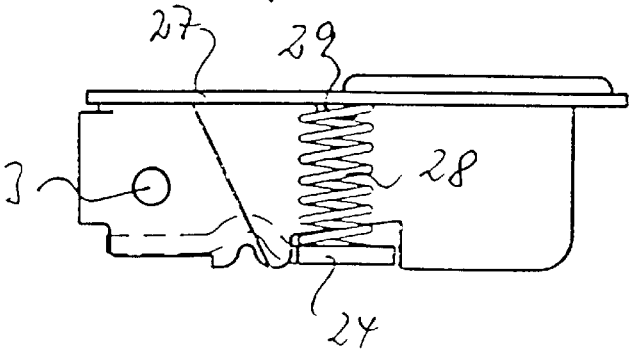
FIG. 4 shows a side view of the hinge cup of FIG. 3.

The hinge visible from FIGS. 1 and 2 comprises a hinge arm 1 provided with a bending at an angle which hinge arm

1 encompasses a hinge axle 3 with its rolled end 2 which equally forms a bearing hole therefor. The hinge axle 3 is unmoveably supported in the conventional manner in the side walls of the cup-shaped hinge part 4.

A tongue 5, which equally forms a lever arm, is bent out of the rolled end 2 of the hinge arm 1.

The hinge arm 1 is guided in a longitudinally movable manner with its rear end 6 on the front side 7 of a retaining arm 8, with the front side 7 being provided with raised side edges 9 which encompass the rear end of the hinge arm 6 for a non-twist guiding. The hinge arm 1 is connected to the front side 7 of the retaining arm 8 by an eccentric 10 so that the hinge arm 1 can be moved relative to the front side 7 of the retaining arm 8 by turning the eccentric 10, for example with a screwdriver, for the lateral adjustment in the direction of the arrow B.

The retaining arm 8 is guided in a longitudinally movable manner on a base plate 12 with the base plate 12 being provided on its front end with laterally bent-down side walls 13 which possess oblong holes 14 in which a pin 15 mounted in the side legs of the retaining arm 8 is guided. The rear end of the retaining arm 8 is connected to the base plate 12 by an eccentric regulation 16 so that by turning the eccentric regulation 16, the hinge can be adjusted in its depth, for example in a cupboard, in the direction of arrow A.

The base plate 12 is provided with a front angle-bend 31 and with a transversely running oblong hole 32 so that it can be connected in the manner shown with the front frame 17, for example, of a cupboard opening, by fastening screws (not shown).

The cup-shaped hinge part 4 is inserted in the conventional manner (not shown) into a flat blind borehole of, for example, a door and thereto by a flange 18 which is part of the cup-shaped hinge part.

The cup-shaped hinge part 4, which comprises a stamped metal part in the embodiment shown, possesses a bottom 13 which is provided with cut-outs on both sides of a strip-shaped part shaped into a reinforcing fin 20 running parallel to the hinge axle 3. On the reinforcing fin 20 arched inwards a two-armed lever 21 is supported which encompasses the reinforcing fin-shaped elevation 20 with a central curvature 22. The two-armed lever's 21 lever arm 23 remote from the hinge is provided in a T-shaped manner with lateral extensions 24 which penetrate the side walls 25 of the hinge cup in roughly trapezium-shaped sections 26 and extend thereover outwardly. Pressure springs 28 are clamped between the parts of the extensions 24 extending over the side walls 25 and the protruding flange-shaped edge 27 of the hinge cup. To hold the pressure springs 28, both the lateral extensions 24 and the protruding flange-shaped edge 27 are provided with knub-like protrusions 29 and embossed in opposite directions to each other which protrude into the inside of the pressure springs 28.

On the lever arm 21 near to the hinge, the tongue-like part 5 bent out of the rolled part 2 of the hinge arm 1 is supported in such a way that a closing moment is transferred thereto only via the lever arm 30 of the lever 21 supported in a rocker-like manner in the closing region visible from FIG. 1.

What is claimed is:

1. A hinge comprising:

a hinge arm (1), a hinge axle (3) upon which said hinge arm (1) is pivotally mounted, a cup-shaped hinge part (4) upon which said hinge axle (3) is retained, said hinge arm (1) comprising one of (i)–(iii):

(i) a tongue (5) extending over said hinge axle (3); or (ii) a cam eccentric to said hinge axle (3); or (iii) a metering notch;

a part pivoted or movably guided in the hinge part (4) and upon which one of the (i) tongue (5), or (ii) cam, or (iii) metering notch is arranged to slide;

at least one spring (28) arranged to charge or act upon said pivoted/movably guided part which is provided with a slide surface such that a closing moment to the cup-shaped hinge part (4) is generated in a closing region or state;

wherein said pivoted/movably guided part comprises a two-armed lever (21) pivoted on said cup-shaped hinged part (4) in a rocker-like manner and comprising two lever arms (23, 30) at respective ends thereof, with said at least one spring (28) being clamped between said cup-shaped hinged part (4) and one (23) of said two lever arms (23, 30) and one of the (i) tongue (5), or (ii) cam, or (iii) metering notch being arranged to slide on the other (30) of said two lever arms (23, 30).

2. The hinge of claim 1, wherein said two armed lever (21) is essentially formed in a flat manner and provided with a central, transversely-running groove (22), and said cup-shaped hinge part (4) comprises a bar or reinforcing fin (20) on a bottom (19) thereof and upon which said lever (21 ) is pivoted at said groove (22).

3. The hinge of claim 2, wherein said one lever arm (23) of said two-armed lever (21) comprises lateral protrusions (24) and said cup-shaped hinge part (4) comprises a protruding flange-shaped edge (27), with pressure springs (28) being clamped between said protrusions (24) and edge (27).

4. The hinge of claim 3, wherein said hinge arm (1) comprises said tongue (5) having a rolled end (2) encompassing said axle (3) and supported upon said other lever arm (30) such that closing moment is only transferred thereto via said other lever arm (30).

5. The hinge arm of claim 3, wherein said cup-shaped hinge part (4) comprises side walls (25) having roughly-trapezium shaped openings (26) through which said lateral protrusions (24) provided on said one lever arm (23) in a T-shaped manner, penetrate and extend thereover outwardly.

6. The hinge of claim 3, wherein said hinge (1) comprises a rear end (6) opposite said (i) tongue (5), or (ii) cam, or (iii) notch, and additionally comprising a retaining arm (8) having a front side (7) possessing edges (9) arranged to encompass the rear end (6) of said hinge arm (1) for non-twist guiding, an eccentric (10) arranged to couple said front side (7) of the retaining arm (8) and said rear end (6) of the hinge arm (1) such that said hinge arm (1) can be adjusted relative to said front side (7) of said retaining arm (8) in a first direction, by turning said eccentric (10), a base plate (12) arranged to be coupled to a fixed structure and provided on a front end with laterally bent-down side walls (13) each having oblong hole (14), said retaining arm (8) comprising side legs each having a pin (15) arranged to be guided in a respective oblong hole (14) of said base plate (12) and an eccentric regulation (16) arranged to couple a rear-end of said retaining arm (8) opposite said front end (7) to said base plate (12), such that said hinge (1) can be adjusted in a second direction substantially perpendicular to said first direction by turning said eccentric regulation (16).

7. The hinge of claim 2, wherein said hinge arm (1) comprises said tongue (5) having a rolled end (2) encompassing said axle (3) and supported upon said other lever arm (30) such that closing moment is only transferred thereto via said other lever arm (30).

8. The hinge of claim 2, wherein said bar or fin (20) extends substantially parallel to said axle (3).

9. The hinge of claim 2, wherein said hinge (1) comprises a rear end (6) opposite said (i) tongue (5), or (ii) cam, or (iii) notch, and additionally comprising a retaining arm (8) having a front side (7) possessing edges (9) arranged to encompass the rear end (6) of said hinge arm (1) for non-twist guiding, an eccentric (10) arranged to couple said front side (7) of the retaining arm (8) and said rear end (6) of the hinge arm (1) such that said hinge arm (1) can be adjusted relative to said front side (7) of said retaining arm (8) in a first direction, by turning said eccentric (10), a base plate (12) arranged to be coupled to a fixed structure and provided on a front end with laterally bent-down side walls (13) each having an oblong hole (14), said retaining arm (8) comprising side legs each having a pin (15) arranged to be guided in a respective oblong hole (14) of said base plate (12) and an eccentric regulation (16) arranged to couple a rear-end of said retaining arm (8) opposite said front end (7) to said base plate (12), such that said hinge (1) can be adjusted in a second direction substantially perpendicular to said first direction by turning said eccentric regulation (16).

10. The hinge of claim 1,wherein said one lever arm (23) of said two-armed lever (21) comprises lateral protrusions (24) and said cup-shaped hinge part (4) comprises a protruding flange-shaped edge (27), with pressure springs (28) being clamped between said protrusions (24) and edge (27).

11. The hinge of claim 10, wherein said hinge arm (1) comprises said tongue (5) having a rolled end (2) encompassing said axle (3) and supported upon said other lever arm (30) such that closing moment is only transferred thereto via said other lever arm (30).

12. The hinge arm of claim 10, wherein said cup-shaped hinge part (4) comprises side walls (25) having roughly-trapezium shaped openings (26) through which said lateral protrusions (24) provided on said one lever arm (23) in a T-shaped manner, penetrate and extend thereover outwardly.

13. The hinge of claim 12,wherein said hinge (1) comprises a rear end (6) opposite said (i) tongue (5), or (ii) cam, or (iii) notch, and additionally comprising a retaining arm (8) having a front side (7) possessing edges (9) arranged to encompass the rear end (6) of said hinge arm (1) for non-twist guiding, an eccentric (10) arranged to couple said front side (7) of the retaining arm (8) and said rear end (6) of the hinge arm (1) such that said hinge arm (1) can be adjusted relative to said front side (7) of said retaining arm (8) in a first direction, by turning said eccentric (10), a base plate (12) arranged to be coupled to a fixed structure and provided on a front end with laterally bent-down side walls (13) each having an oblong hole (14), said retaining arm (8) comprising side legs each having a pin (15) arranged to be guided in a respective oblong hole (14) of said base plate (12) and an eccentric regulation (16) arranged to couple a rear-end of said retaining arm (8) opposite said front end (7) to said base plate (12), such that said hinge (1) can be adjusted in a second direction substantially perpendicular to said first direction by turning said eccentric regulation (16).

14. The hinge of claim 12, comprising knub-like protrusions (29) embossed in opposite directions to each other upon said lateral protrusions (24) and the protruding flange-shaped edge (27) and upon which said pressure springs (28) are retained with said knub-like protrusions (29) protruding into an interior of said pressure springs (28).

15. The hinge of claims 14, comprising knub-like protrusions (29) embossed in opposite directions to each other upon said lateral protrusions (24) and the protruding flange-shaped edge (27) and upon which said pressure springs (28) are retained with said knub-like protrusions (29) protruding into an interior of said pressure springs (28).

16. The hinge of claim 1, wherein said hinge (1) comprises a rear end (6) opposite said (i) tongue (5), or (ii) cam, or (iii) notch, and additionally comprising a retaining arm (8) having a front side (7) possessing edges (9) arranged to encompass the rear end (6) of said hinge arm (1) for non-twist guiding, an eccentric (10) arranged to couple said front side (7) of the retaining arm (8) and said rear end (6) of the hinge arm (1) such that said hinge arm (1) can be adjusted relative to said front side (7) of said retaining arm (8) in a first direction, by turning said eccentric (10), a base plate (12) arranged to be coupled to a fixed structure and provided on a front end with laterally bent-down side walls (13) each having an oblong hole (14), said retaining arm (8) comprising side legs each having a pin (15) arranged to be guided in a respective oblong hole (14) of said base plate (12) and an eccentric regulation (16) arranged to couple a rear-end of said retaining arm (8) opposite said front end (7) to said base plate (12), such that said hinge (1) can be adjusted in a second direction substantially perpendicular to said first direction by turning said eccentric regulation (16).

17. The hinge of claim 10, wherein said hinge (1) comprises a rear-end (6) opposite said (i) tongue (5), or (ii) cam, or (iii) notch, and additionally comprising a retaining arm (8) having a front side (7) possessing edges (9) arranged to encompass the rear end (6) of said hinge arm (1) for non-twist guiding, an eccentric (10) arranged to couple said front side (7) of the retaining arm (8) and said rear end (6) of the hinge arm (1) such that said hinge arm (1) can be adjusted relative to said front side (7) of said retaining arm (8) in a first direction, by turning said eccentric (10), a base plate (12) arranged to be coupled to a fixed structure and provided on a front end with laterally bent-down side walls (13) each having an oblong hole (14), said retaining arm (8) comprising side legs each having a pin (15) arranged to be guided in a respected oblong hole (14) of said base plate (12), and an eccentric regulation (16) arranged to couple a rear-end of said retaining arm (8) opposite said front end (7) to said base plate (12), such that said hinge (1) can be adjusted in a second direction substantially perpendicular to said first direction by turning said eccentric regulation (16).

18. The hinge of claim 1, wherein said hinge arm (1) comprises said tongue (5) having a rolled end (2) encompassing said axle (3) and supported upon said other lever arm (30) such that closing moment is only transferred thereto via said other lever arm (30).

19. The hinge of claim 18, wherein said hinge (1) comprises a rear end (6) opposite said tongue (5), and additionally comprising a retaining arm (8) having a front side (7) possessing edges (9) arranged to encompass the rear-end (6) of said hinge arm (1) for non-twist guiding, an eccentric (10) arranged to couple said front side (7) of the retaining arm (8) and said rear end (6) of the hinge arm (1) such that said hinge arm (1) can be adjusted relative to said front side (7) of said retaining arm (8) in a first direction, by turning said eccentric (10), a base plate (12) arranged to be coupled to a fixed structure and provided on a front end with laterally bent-down side walls (13) each having an oblong hole (14), said retaining arm (8) comprising side legs each having a pin (15) arranged to be guided in a respective oblong hole (14) of said base plate (12), and an eccentric regulation (16) arranged to couple a rear-end of said retaining arm (8) opposite said front end (7) to said base plate (12), such that said hinge (1) can be adjusted in a second direction substantially perpendicular to said first direction by turning said eccentric regulation (16).

* * * * *